United States Patent [19]

Reick

[11] 4,349,444

[45] Sep. 14, 1982

[54] HYBRID PTFE LUBRICANT INCLUDING MOLYBDENUM COMPOUND

[75] Inventor: Franklin G. Reick, Westwood, N.J.

[73] Assignee: Michael Ebert, Mamaroneck, N.Y.; a part interest

[21] Appl. No.: 218,008

[22] Filed: Dec. 18, 1980

Related U.S. Application Data

[63] Continuation-in-part of Ser. No. 158,329, Jun. 10, 1980, Pat. No. 4,284,518.

[51] Int. Cl.[3] ..... C10M 1/30

[52] U.S. Cl. ..... 252/16; 252/54.6; 252/46.4; 252/58

[58] Field of Search ..... 252/16, 54.6, 58, 46.4

[56] References Cited

U.S. PATENT DOCUMENTS 3,933,656 1/1976 Reick ..... 252/58
4,127,491 11/1978 Reick ..... 252/16
4,202,781 5/1980 Sabol et al. ..... 252/46.4
4,284,518 8/1981 Reick ..... 252/16

*Primary Examiner*—Winston A. Douglas
*Assistant Examiner*—J. V. Howard
*Attorney, Agent, or Firm*—Michael Ebert

[57] ABSTRACT

A hybrid lubricant in which microfine PTFE particles are uniformly dispersed in an oil carrier that includes a small but effective amount of an oil-soluble organic molybdenum compound, the hybrid lubricant being diluted with a major amount of a conventional lubricating oil. In operation, a thin film of the molybdenum compound is developed on the rubbing metal surfaces of the lubricated engine, the film reacting in the high-temperature, high-pressure environment of the rubbing surfaces to form a fluoride to which the PTFE particles bond to impart thereto an extremely low coefficient of friction to afford the benefits of both solid and fluid lubrication. The hybrid lubricant minimizes friction under all operating conditions regardless of their severity, and it reduces wear on the engine.

5 Claims, No Drawings

HYBRID PTFE LUBRICANT INCLUDING MOLYBDENUM COMPOUND

RELATED APPLICATION

This application is a continuation-in-part of my application Ser. No. 158,329, filed June 10, 1980, entitled "Stabilized Hybrid Lubricant," now U.S. Pat. No. 4,284,518 which relates back through still earlier patent applications to my U.S. Pat. No. 4,127,491, issued Nov. 28, 1978. The entire disclosures of these earlier-filed applications are incorporated herein by reference.

BACKGROUND OF INVENTION

This invention relates generally to lubricants, and more particularly to a hybrid lubricant in which microfine particles of PTFE are dispersed in an oil lubricant carrier that includes a small but effective amount of an oil-soluble organic molybdenum compound that renders the hybrid lubricant effective throughout the entire pressure range, including extreme pressures.

Even the most carefully finished metal surfaces have minute projections and depressions therein which introduce resistance when one surface shifts relative to another. The application of a fluid lubricant to these surfaces reduces friction by interposing a film of oil therebetween, this being known as hydrodynamic lubrication. In a bearing, for example, the rotation of the journal causes oil to be drawn between it and the bearing so that the two metal surfaces are then separated by a very thin oil film. The degree of bearing friction depends on the viscosity of the oil, the speed of rotation and the load on the journal.

Should the journal start its rotation after a period of rest, it may not drag enough oil to float the surfaces apart; hence friction would then be considerably greater; the friction being independent of the viscosity of the lubricant and being related only to the load and to the "oiliness" property of the residual lubricant, causing it to stick tightly to the metal surfaces. This condition is referred to as "boundary lubrication," for the moving parts are then separated by a film of only molecular thickness. This may cause serious damage to overheated bearing surfaces.

The two most significant characteristics of a hydrodynamic lubricant are its viscosity and its viscosity index, the latter being the relationship between viscosity and temperature. The higher the index, the less viscosity will change with temperature. Fluid lubricants act not only to reduce friction, but also to extract heat developed within the machinery as well as a protection against corrosion.

Though fluid film separation of rubbing surfaces is the most desirable objective of lubrication, in practice it is often unobtainable. Thus bearings built for full fluid lubrication during most of their operating phases actually experience solid-to-solid contact when starting and stopping.

Typical solid lubricants are soft metals such as lead, layer lattice crystals such as graphite and molybdenum disulphide, and crystalline polymers such as "FLUON" (polytetrafluoroethylene, or PTFE). Integral bonding of these solid lubricants to the surfaces of the bodies to be lubricated is desirable for good performance.

Under severe operating conditions usually encountered in automotive transmissions and in internal combustion engines, hydrodynamic or fluid lubrication is inadequate to minimize friction and wear; for fluid film separation of the rubbing surfaces is not possible through all phases of operation. Hence, the ideal lubricant for engines or other mechanisms having moving parts is one combining hydrodynamic with solid lubrication. In this way, when adequate separation exists between the rubbing surfaces, a protective fluid film is interposed therebetween; and when these surfaces are in physical contact with each other, friction therebetween is minimized by interposing solid lubricants between these surfaces.

In theory, one can best approach this ideal by lining the rubbing parts of engines with solid lubricant layers which are integrally bonded thereto, concurrent use being made of a lubricating oil which functions not only to provide hydrodynamic lubrication but also to cool the rubbing parts. In addition, the oil may carry synthetic organic chemicals to carry out other functions to counteract wear and prevent corrosion.

The practical difficulty with attaining this ideal is that parts coated with solid lubricants, such as a PTFE layer, are very expensive and therefore add considerably to the overall cost of the engine. Moreover, in PTFE-coated parts which operate under rigorous conditions, the solid lubricant layers bonded thereto have a relatively short working life, so that is is not long before the only lubricant which remains effective in the engine is the fluid lubricant.

In order to provide lubricating activity that has both solid and fluid components, my prior U.S. Pat. No. 4,127,491 and the above-identified related applications disclose a modified oil lubricant suitable for an internal combustion engine provided with an oil filter as well as for many other applications which call for effective lubrication throughout all phases of operation. This modified lubricant is constituted by major amounts of a conventional lubricating oil intermingled with minor amounts of an aqueous dispersion of polytetrafluoroethylene (PTFE) particles in the sub-micronic range in combination with a neutralizing agent which stabilizes the dispersion to prevent agglomeration and coagulation of the particles. The modified lubricant is therefore capable of passing through the oil filter without separating the solid particles from the oil in which it is dispersed.

This modified lubricant has many significant advantages; for, as indicated in my prior patent, it reduces wear and thereby prolongs engine life; it makes possible a sharp reduction in the emission of pollutants and also effects a significant improvement in fuel economy, the last factor being of overriding importance in a fuel-short world.

A hybrid lubricant of the type disclosed in my earlier-filed patent applications is most effective as a friction reducer when the friction arises from contact pressure between rubbing metal parts that is spread over a broad area, such contact pressure arising, for example, at the interface between a shaft and a sleeve bearing within which the shaft rotates. Though friction encountered in internal combustion engines largely falls into the broad contact category, the engine also has high points in various regions wherein the friction is concentrated at point contact areas. Because of the resultant extreme pressures, these point contact areas are difficult to lubricate effectively and run relatively hot. A solid PTFE lubricant layer is difficult to maintain on point contact surfaces and a hybrid lubricant of my prior type is therefore of limited effectiveness under extreme pressure-point contact conditions in an engine.

As pointed out in my copending application Ser. No. 158,329, when the colloidal PTFE particles in the hybrid lubricant are brought into contact with rubbing metal surfaces formed of aluminum or other metals having porous oxide surfaces, the PTFE particles are impregnated into the granular interstices and voids to create thereon a thin PTFE layer which renders these surfaces extremely slippery.

However, steel and other metals having non-oxidized surfaces resist impregnation by the PTFE particles in the hybrid lubricant. Where the rubbing surfaces in the engine are aluminum against steel, the PTFE layer developed on the aluminum affords the necessary solid lubricant at the interface thereof. But when the surfaces are both steel, a hybrid lubricant of the type disclosed in my prior applications and patents is then less effective as a friction reducer, particularly when point contact conditions are involved.

SUMMARY OF INVENTION

In view of the foregoing, the main object of this invention is to provide a hybrid lubricant in which microfine PTFE particles are uniformly dispersed by a fluorochemical surfactant to form an additive that, when diluted with a major amount of a conventional oil lubricant, functions in the environment of rubbing surfaces to develop a layer of solid lubricant thereon, the hybrid lubricant including a small but effective amount of an oil-soluble organic molybdenum compound that renders the lubricant effective in the full range of pressure conditions encountered in a machine or engine, including extreme pressures.

A significant feature of a hybrid lubricant in accordance with the invention is that the soluble molybdenum compound develops a thin film on the metal rubbing surfaces being lubricated that reacts with the fluoro-chemicals in the high-temperature, high-pressure environment of the surfaces to form a fluoride having an affinity for the PTFE particles, as a consequence of which these particles bond tightly to the film to establish a solid lubricant thereon capable of withstanding extremely high pressures.

The use of hybrid lubricant in accordance with the invention as an additive for standard crankcase oil in a diesel or internal combustion engine brings about distinctly better performance, increased mileage for a given amount of fuel, faster cold starts and an absence of hesitation. The additive reduces friction and wear, yet is resistant to coagulation and agglomeration, and does not clog oil filters. And because the hybrid lubricant makes it possible to operate at lower idling speeds and with very lean air/fuel mixtures, the emission of unburned hydrocarbons and carbon monoxide from the exhaust is sharply reduced, thereby minimizing the discharge into the atmosphere of noxious pollutants. The additive is also useful in industrial machinery and in other applications to reduce noise as well as friction.

DESCRIPTION OF INVENTION

A hybrid lubricant in accordance with the invention includes a solid lubricant in the form of microfine particles of polytetrafluoroethylene (PTFE). Since these particles must pass easily through an oil filter and between closely machined metal surfaces such as those existing in hydraulic valve lifters, it is desirable that the particles be of sub-micronic size. Suitable, therefore, as the starting material for a hybrid lubricant in accordance with the invention are the duPont "Teflon" dispersions TFE-42 and T-30 whose particle sizes are in the 0.5 to 0.05 micron range. Also acceptable is the "Fluon" ADO 38 TFE colloidal dispersion manufactured by ICI (Imperial Chemical Industries, Ltd.).

Since the present invention uses essentially the same procedure for making a hybrid lubricant in accordance with the invention as is described in applicant's prior U.S. Pat. No. 4,127,491 and in the other above-identified related applications, except that the hybrid lubricant further includes an oil-soluble organic molybdenum compound, we shall first describe the steps (1 to 4) involved without this compound, and then describe the final step (5) in which the soluble compound is included in the lubricant.

STEP NO. 1

The aqueous dispersion of colloidal PTFE particles must first be rendered stable to avoid agglomeration of the particles. For this purpose, use is made of a fluorochemical surfactant which acts to neutralize or stabilize the surface charges in the particles to make them more uniform and thereby prevent "electret" or other effects causing agglomeration.

Best results are obtained when the PTFE dispersion to be treated is received from the pressure reactor immediately following polymerization. PTFE particles are extremely hydrophobic and air tends to wet the particles better than water. It is for this reason that the solutions are usually shipped with a mineral oil layer to keep gases away and retard agglomeration. And while to make the hybrid lubricant, one may use commercially-available PTFE dispersions that have been shipped and stored as long as the dispersions are reasonably free of agglomerates, it is preferable to start with ex-reactor dispersions to sidestep the danger of agglomeration.

Fluorochemical surface active agents or surfactants are available which are anionic, cationic or nonionic. Among these fluorosurfactants are Zonyl (duPont) and Monoflor (ICI). Zonyl is a modified polyethylene glycol type that is nonionic. For engine lubrication applications, good results have been obtained with an anionic (−) fluorosurfactant commercially available from ICI. Monoflor 32, produced by ICI, is of particular interest, this being an anionic fluorochemical whose composition is 30% w/w/ active solids in diethylene glycol mono butyl ether.

STEP NO. 2

The stabilized aqueous PTFE dispersion produced in Step No. 1 is then intermingled with a fluid lubricant carrier, preferably one which is the same or fully compatible with the lubricating oil in the engine to which the hybrid lubricant is to be added. By intermingling the stabilized aqueous PTFE dispersion with the carrier, an emulsion is formed. For this purpose, use may be made of Quaker State 10W-40 SAE lubricating oil, Shell X-100, or Uniflo oil.

STEP NO. 3

In the emulsion formed in step no. 2, the aqueous dispersion is distributed throughout the oil carrier in the form of relatively large globules. It is desirable that this emulsion be homogenized by subjecting it to turbulent treatment to cause the globules to break up and reduce in size to create a fine uniform dispersion of colloidal PTFE in the fluid lubricant carrier.

To promote such homogenization, use is preferably made of a polymeric dispersant such as ACRYLOID 956 manufactured by Rohm and Haas. This dispersant, which is generally used as a viscosity index improver or sludge dispersant, is a polyalkylmethacrylate copolymer in a solvent-refined neutral carrier oil. Also useful for this purpose are GANEX V516 polymeric dispersants manufactured and sold by GAF. To obtain a very fine particle dispersion in the emulsion, this step is preferably carried out in two successive stages. In the first stage, a portion of the dispersant is sheared into the high viscosity Acryloid 956, after which the remainder is added.

STEP NO. 4

As a result of carrying out steps 1 to 3, we now have a homogenized emulsion in which stabilized PTFE particles are uniformly dispersed in a fluid lubricant carrier. In this step, added to this emulsion is an absorbent surfactant which will render the rubbing surfaces to be lubricated conducive to impregnation by the colloidal PTFE particles.

Where the surfaces to be lubricated are metal, the surfactant is one appropriate to metal. A preferred surfactant for this purpose is Surfy-nol 104 manufactured by Airco Chemicals and Plastics. This is a white, waxy, solid tertiary, acetylenic glycol which has an affinity for metal and functions as a wetting agent. It improves adhesion on metal due to its excellent wetting power.

STEP NO. 5

In this step, there is added to the hybrid PTFE lubricant produced by steps 1 to 4 a small but effective amount of an oil-soluble molybdenum compound of the type presently available commercially as an additive to automobile lubricating oils for heavy loads and extreme pressure (EP) applications.

One example of this compound is "MOLYVAN L," the trademarked product of the R. T. Vanderbilt Company, Inc., of Norwalk, Conn. This organic molybdenum compound is composed of molybdenum as $MoO_3$ (10.6%), sulfur (14.0%) and phosphorus (4.5%).

Another example is Elco L-28901 (molybdenum dialkyl dithiophosphate), produced by the Elco Corporation of Cleveland, Ohio. This oil-soluble additive contains a high concentration of molybdenum in relation to phosphorus and sulfur. In the Elco compound, the molybdenum-to-phosphorus ratio is typically 5 to 1. As pointed out in the Preliminary Bulletin published by Elco, this compound is soluble in all types of lubricating oils and acts not only as an extreme pressure, anti-wear agent, but also as an antioxidant. In many instances, its activity is enhanced by the incorporation of Elco 217, a sulfurized hydrocarbon.

Other examples of oil soluble compounds based on molybdenum, such as sulphurized oxymolybdenum organophosphorodithiolate and molybdenum dithiolate, are disclosed in the article by Braithwaite and Greene, "A Critical Analysis of The Performance of Molybdenum Compounds in Motor Vehicles," appearing in *Wear*, Vol. 46., No. 2, pp 405–432, February 1978.

An oil-soluble organic molybdenum compound of the type commercially available does not significantly enhance the lubricating characteristics of standard lubricating oils under ordinary pressure conditions, such as those encountered in broad contact areas, and is not prescribed in the literature for such applications.

We have discovered, however, that when the soluble moly compound is combined with a hybrid lubricant containing PTFE particles dispersed by a fluorochemical surfactant, a synergistic effect is obtained, resulting in a marked reduction of friction throughout the entire pressure range when a small but effective amount thereof is included in the hybrid lubricant, such as about 1%.

In operation when lubricating rubbing metal surfaces, an extremely fine film of the molybdenum compound is developed on the metal surfaces. Because of the high temperature and high pressure conditions which prevail at the interface of the rubbing surfaces, this film reacts with the fluorochemicals which are carried into the interface to form a fluoride (molybdenum hexafluoride). It is known that when heated in the presence of fluorine, chlorine or bromine, molybdenum combines directly to form the corresponding halogen derivative. In the case of a fluorine, molybdenum hexafluoride is the reaction product, this being a white, crystalline substance.

This substance has an affinity for the PTFE particles which are caused in the course of operation under the prevailing conditions of temperature and pressure to bond tightly to the fluoride skin formed on the metal surface (particularly steel) to create an extremely thin PTFE layer thereon having an extremely low coefficient of friction. This layer survives even under extreme pressures; and though it may be eroded with time, it is recreated in the course of operation by the presence of the moly compound and the PTFE particles.

Thus, even in the case of steel and other metals which resist surface impregnation by PTFE particles, the inclusion of the moly compound makes possible the formation thereon of a PTFE anti-friction layer.

While the relative amount of the molybdenum compound in the hybrid lubricant is not critical, we have found in our tests that when the percentage of the compound is less than about 1%, such as ½ and ¼ percent, in plotting temperature against time, the resulting characteristic curve proceeds to approach the curve obtained with the hybrid lubricant in the absence of the moly compound, wherein the temperature rises with time; and that when the percentage of the compound exceeds 1%, again the characteristic curve proceeds to approach that of the untreated hybrid lubricant—the larger the percentage of moly above 1%, the greater the rise in temperature with time.

When, however, the percentage of moly is about one percent in the hybrid lubricants tested, the curve of temperature vs. time flattens out after reaching a relatively low temperature level.

Hence in practice, the percentage of the molybdenum compound must be small and should be such as to attain for a given hybrid lubricant containing PTFE particles dispersed therein, an optimum relationship between time and temperature. We believe that if the amount of the moly compound is excessive relative to the hybrid PTFE lubricant, the resultant film formed on the metal surface is unduly thick and has a lesser tendency to react to produce the fluoride skin; whereas if the amount is insufficient, a film adequate for creating the fluoride skin is not produced.

While there has been shown and described a preferred formulation of a hybrid PTFE lubricant including a molybdenum compound in accordance with the invention, it will be appreciated that many changes and modifications may be made therein without, however, departing from the essential spirit thereof.

I claim:

1. A hybrid lubricant additive dilutable in a conventional fluid oil lubricant to provide a working lubricant applicable to metallic working surfaces, such as those found in internal combustion engines and industrial machinery, said hybrid lubricant additive comprising:

A. a dispersion of polytetrafluoroethylene solid lubricant particles;

B. a neutralizing agent added to said dispersion in an amount stabilizing the dispersion to prevent agglomeration of the particles;

C. a fluid oil lubricant carrier intermingled with the stabilized dispersion to provide a predetermined amount of hybrid lubricant additive; and D. a small but effective amount of an oil-soluble organic molybdenum compound included in said additive to render it effective in forming a solid lubricant layer on said metallic working surfaces.

2. An additive as set forth in claim 1, wherein said neutralizing agent is a fluorochemical surfactant.

3. An additive as set forth in claim 1, wherein said dispersion is of colloidal particles in the sub-micron range.

4. An additive as set forth in claim 1, wherein said compound is constituted by molybdenum, phosphorus and sulfur.

5. An additive as set forth in claim 1, wherein said compound is molybdenum dithiolate.

* * * * *